United States Patent [19]

Emmer

[11] Patent Number: 4,704,831

[45] Date of Patent: Nov. 10, 1987

[54] FACADE WALL

[75] Inventor: Hans Emmer, Liestal, Switzerland

[73] Assignee: Eltreva AG, Aesch, Switzerland

[21] Appl. No.: 925,944

[22] Filed: Nov. 3, 1986

[30] Foreign Application Priority Data

Nov. 2, 1985 [DE] Fed. Rep. of Germany ..... 3539002

[51] Int. Cl.[4] ..... E04B 2/88

[52] U.S. Cl. ..... 52/235; 52/474; 52/726

[58] Field of Search ..... 52/235, 726, 474–477, 52/234

[56] References Cited

U.S. PATENT DOCUMENTS

| | | | |
|---|---|---|---|
| 3,940,897 | 3/1976 | Stoakes | 52/235 |
| 4,055,923 | 11/1977 | Biebuyck | 52/235 |
| 4,574,546 | 3/1986 | Gartner | 52/235 |
| 4,614,067 | 9/1986 | Matsubara | 52/235 |
| 4,638,613 | 1/1987 | Tonsmann | 52/235 |

FOREIGN PATENT DOCUMENTS

| | | | |
|---|---|---|---|
| 913773 | 12/1962 | United Kingdom | 52/235 |
| 1417393 | 12/1975 | United Kingdom | 52/235 |
| 2172911 | 10/1986 | United Kingdom | 52/235 |

*Primary Examiner*—J. Karl Bell

*Attorney, Agent, or Firm*—Schwartz, Jeffery, Schwaab, Mack, Blumenthal & Evans

[57] ABSTRACT

A facade wall with a loadbearing skeleton of vertical posts and cross members inserted between the posts and connected at right angles thereto, which together form skeleton panels, provided with a seal, for receiving one plate element each, the post profile comprising in cross-section a room-side box profile portion and a weather-side head profile portion of smaller width and having on either side of the head profile a vertically extending seal retaining groove in the weather-side box profile surface. Lower and upper seal retaining grooves are provided in the cross member on the weather side. The cross member profile comprises a box profile portion and a head profile portion, which is arranged between the two horizontal seal retaining grooves and has horizontal seal retaining grooves in its upper and lower sides, each of which grooves is aligned with a vertical seal retaining groove in an associated side surface of the post profile head profile portion. Extending around a skeleton panel is a sealing profile, having a first retaining foot which engages the lower or upper seal retaining groove in the head profile of the cross member and the vertical seal retaining grooves in the side surfaces of the head profile portions of the post profiles, and having a second retaining foot which engages the lower or upper seal retaining groove in the box profile portion of the cross member and the vertical seal retaining grooves of the weather-side box profile surfaces of the post profiles.

12 Claims, 4 Drawing Figures

FACADE WALL

BACKGROUND OF THE INVENTION

The present invention relates to a facade wall with a loadbearing skeleton of vertical posts and cross members inserted between the posts and connected at right angles thereto which together form skeleton panels, provided with a seal, for receiving one plate element each, the post profile consisting in cross-section of a room-side box profile and a weather-side head profile of smaller width and having on either side of the head profile a vertically extending seal retaining groove in the weather-side box profile surface, while lower and upper horizontal seal retaining grooves are provided in the cross member on the weather side.

Such an arrangement is disclosed in German Patent Specification No. 3,040,642. Although this previously known structure has proven successful, it is relatively complex to manufacture and assemble since milled-out portions are necessary in the post profile. Furthermore, the sealing proves problematical, particularly in the corner regions.

SUMMARY OF THE INVENTION

The object of the invention is to provide a facade wall of the initially described type which is simplified with regard to its manufacture and assembly and at the same time ensures a reliable sealing, particularly in the corner regions.

These object are achieved according to the invention by providing a facade wall of the foregoing general type in which (a) the cross member profile is made up of a box profile portion and a head profile portion, which is arranged between the two horizontal seal retaining grooves and has in its upper side and in its lower side a horizontal seal retaining groove, the extension of which opens into a vertical seal retaining groove in the associated side surface of the head profile portion of the post profile;

(b) extending around a skeleton panel is a sealing profile, which engages by means of a first retaining foot in the lower or upper seal retaining groove in the head profile of the cross member and in the vertical seal retaining grooves in the side surfaces of the head profiles of the two post profiles and by means of a second retaining foot in the lower or upper seal retaining groove in the box profile of the cross member and in the vertical seal retaining grooves of the weather-side box profile surfaces of the two post profiles.

Thus, according to the invention, the sealing surface is disposed completely on the weather side, and no further sealing is necessary on the room side between post and cross member.

It is advantageous in this arrangement if a flexible insert or filling piece with a seal retaining groove is inserted between the head profiles of the two post profiles, and this insert seal retaining groove is aligned with the seal retaining grooves in the side surface of the head profile of the post. Furthermore, it is desirable if a flexible filling piece is inserted between the head profiles of the cross member and of the upper post profile, which filling piece has on its lower side and on its upper side a seal retaining groove which is aligned with the corresponding seal retaining groove in the head profile of the cross member. In case of an impact against the post, the filling pieces ensure at the post joint that the sealing profile in the base of the groove remains anchored all the way around to the post and cross member profiles through the retaining foot. Dilatations or movements in the post joint can be absorbed by the flexible filling pieces.

In order to achieve a full-area sealing surface on the room side with the sealing profile, it is advantageous if a filling profile extending across the connecting piece between the two post profiles is pushed into each of the seal retaining grooves provided in the weather-side box profile surfaces of the two post profiles. A plate element built into the sealing profile can thus move in the sealing bed, which is closed all around, making it possible to absorb movements of the post and cross member profiles relative to each other without the sealing surface with the plate element being interrupted at any point.

It is also possible within the scope of the invention for the entire corner sealing region to be formed by a correspondingly designed shaped part vulcanized into the sealing profile.

It is advantageous if an assembly slot is provided centrally in the weather-side surface of each head profile portion of the cross members and of the post profiles, and if the sealing profile covers these head profile portions in each case up to the assembly slot. This assembly slot may in each case open in an undercut groove, which serves to receive clamping means for attaching cover profiles or the like. A structure may be provided such as disclosed in my concurrently filed U.S. patent application entitled "Frame Structure", the disclosure of which is incorporated herein by reference.

According to a particularly preferred embodiment of the invention the following features are preferably provided at each post/cross member intersection:

(a) In each case two vertically aligned post profiles are connected to each other, with a clear, variable distance between them by means of a connecting piece inserted in their box profiles.

(b) A horizontal support bolt is inserted through the upper of the two box profiles and at the same time through the upper section of the connecting piece. The support bolt is secured against longitudinal displacement, has two ends which protrude from opposite ends of the box profile, and in each case forms a support for a cross member.

(c) The cross member profile has an entry slot for pushing the cross member onto one end of the support bolt and a horizontal, downwardly open support web having an approximately semi-circular cross-section, by means of which the cross member is suspended in its assembled position on said one end of the support bolt.

(d) A horizontal locking bolt is inserted through the head profile portion of the post profile, and the ends of the locking bolt engage in corresponding recesses of two laterally adjacent cross members.

In this structure according to the invention, the post and cross member profiles can be cut to size by simple transverse cuts; milled-out portions are no longer necessary. All bores lie in the same bore axis, so that the profiles can be machined without repositioning. While vertical post connections were previously welded, now the support bolt according to the invention serves at the same time as a support for the cross members and for attaching the connecting piece to the post joint. The bolts used according to the invention represent inexpensive connecting elements in comparison with welded-on or screwed-on angle supports.

The support bolt can be secured on either side of the box profile of the upper post profile in a simple way by a Seeger ring or the like. According to the invention, the length of the cross member is then shorter by at least twice the thickness of this Seeger ring or the like than the clear distance between two adjacent posts. This makes it possible for the cross members to be fitted particularly easily and without damaging the side surfaces of the post profiles.

Since an intermediate space remains in each case between the head profile portions of the upper post profile and the cross members, the locking bolt can be secured particularly easily by means of a Seeger ring provided in this intermediate space. Thus, a particularly easy assembly is facilitated in this respect as well.

Further features of the invention will be explained hereinafter in more detail with reference to an illustrative preferred embodiment.

BRIEF DESCRIPTION OF THE DRAWINGS

An embodiment of the invention is represented as an example in the drawing, in which.

DETAILED DESCRIPTION OF PREFERRED EMBODIMENTS

Figure 1:
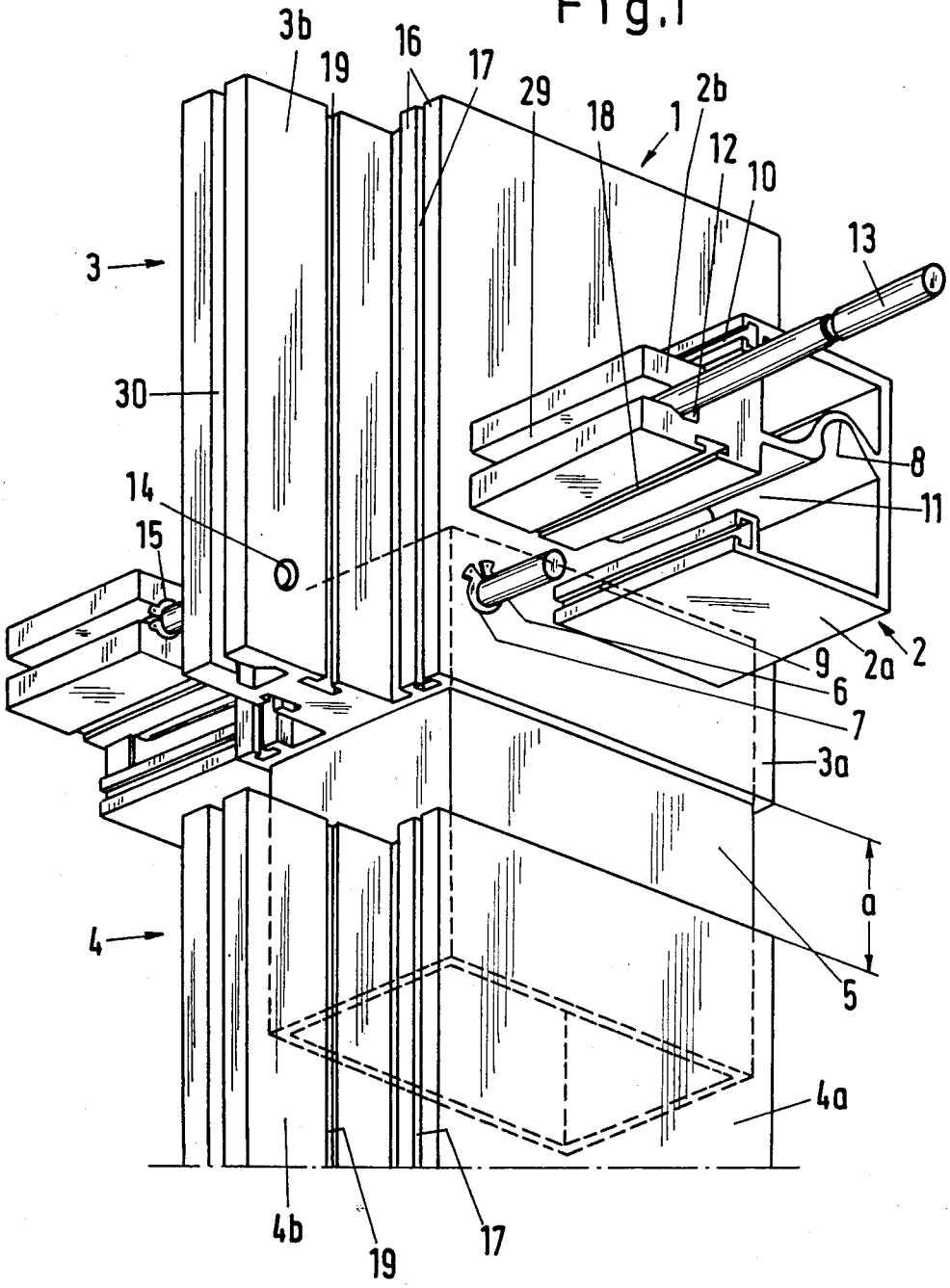
FIG. 1 shows, in isometric representation, the region of a post/cross member intersection of a facade wall, viewed from slightly underneath and looking from the weather side toward the room side.

FIG. 1 shows within a facade wall (not shown in more detail) an intersecting region between a post 1 and two cross members 2. In the illustrated section, the post 1 is formed by two post profiles 3 and 4 which are connected to each other by means of an inserted connecting piece 5 such that they are aligned flush with each other in the vertical direction with a clear, variable distance "a" between them. Each post profile 3 and 4 comprises in cross-section a room-side box profile portion 3*a*, 4*a* and a weather-side head profile portion 3*b*, 4*b* of smaller width. The connecting piece 5 has one end pushed into the upper end of the lower box profile 4*a* and its other end pushed into the lower end of the upper box profile 3*a* and is fixed in the latter by means of a support bolt 6, which is inserted horizontally through box profile portion 3*a* parallel to the facade wall, and is secured against longitudinal displacement on either side of box profile portion 3*a* by means of a Seeger ring 7. The two ends of support bolt 6 protrude from the box profile portion 3*a*. At least one of the two post profiles 3 or 4 is fixed in a conventional manner (not shown) to the base structure. Since a free perpendicular displaceability is ensured between the lower post profile 4 and the connecting piece 5, thermal expansions of the post profiles 3, 4 can be compensated for in this joint region.

Figure 2:
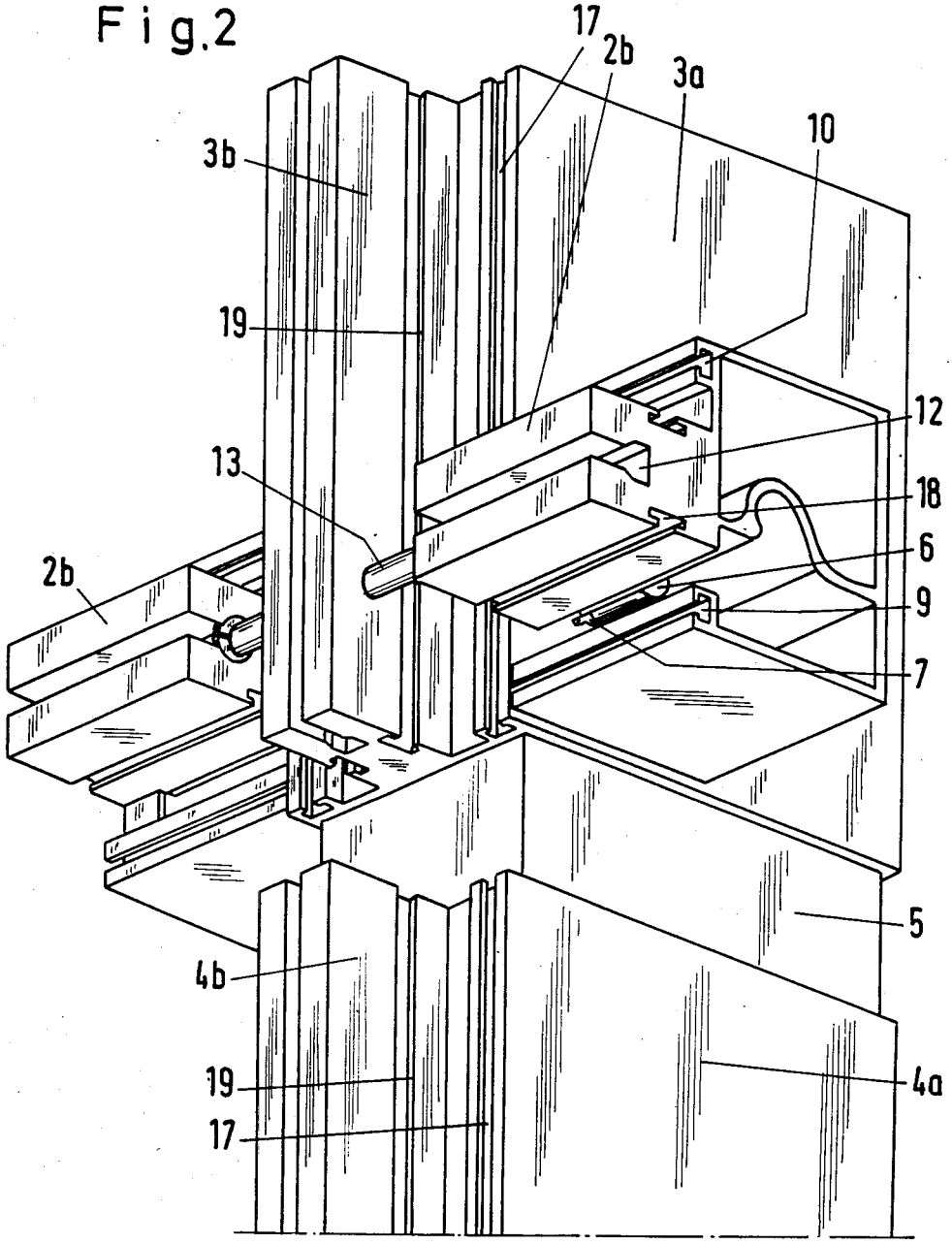
FIG. 2 shows the device of FIG. 1 with assembled cross members.

Each cross member profile 2 is made up of a box profile portion 2*a* and a head profile portion 2*b*, which is arranged on the weather side on the box profile portion 3*a* and is designed narrower than the box profile portion. Within the box profile portion 2*a* there is arranged a support web 8 which is designed approximately semicircular in cross-section and opens downward and is associated with one of the two protruding ends of the support bolt. Due to the fact that the cross-section of support web 8 extends by somewhat more than 180° of circumference, it forms an undercut to secure the cross member 2 against being lifted up. Arranged in the weather-side surface of the box profile portion 2*a*, both above and below the head profile portion 2*b*, are seal retaining grooves 9 and 10 extending along the full length of the cross member profile. Between the lower seal retaining groove 9 and the head profile 2*b* of the cross member 2 there is an entry slot 11 for the support bolt 6, so that the cross member 2 can be pushed from the room side onto two assigned support bolts 6 and lowered onto the bolts until the support bolts 6 engage the support web 8 (see FIG. 1, left-hand cross member, and FIG. 2).

In FIG. 1, the right-hand cross member 2 is shown at the beginning of its assembly. The length of the cross member 2 is shorter by twice the thickness of Seeger ring 7 than the clear distance between two adjacent vertical posts 1. This makes it possible for the cross member 2 to be inserted easily and without risk of damaging the surface of the box profile 3*a* of post 1. On the room side, although this retains a clear distance between cross member 2 and post 1 corresponding to the thickness of the Seeger ring 7, this distance can—wherever this is desired for visual reasons—be closed by means of a pressed-in seal or the like.

In the head profile portion 2*b* of the cross member 2 there is provided an elongate recess 12, into which a displaceable locking bolt 13 is pushed longitudinally. When cross member 2 is mounted, elongate recess 12 and locking bolt 13 are aligned with a horizontal bore 14 in the head profile portion 3*b* of the upper post profile 3. Once the cross member 2 has been suspended from two support bolts 6 in the manner described above, the locking bolt 13, previously arranged in elongate recess 12 during fabrication, is pushed by means of a suitable tool through the bore 14 into the corresponding recess 12 of the neighboring cross member 2 and secured against longitudinal displacement by Seeger rings 15, which are arranged in each case in the intervening space between cross member 2 and the head profile portion 3*a* of the post.

The post profile 3, 4 has on either side of its head profile portion 3*b*, 4*b* a seal retaining groove 17 extending vertically in the weather-side box profile surface 16. Grooves 17 lie in the same plane as the two abovementioned seal retaining grooves 9, 10 in the box profile portion 2*a* of the cross member 2. Arranged in the upper side and in the lower side of the head profile portion 2*b* of the cross member 2 is a horizontal seal retaining groove 18, the extension of which opens into a vertical seal retaining groove 19 in the facing side surface of the head profile portion 3*b* of the post 1.

Figure 3:
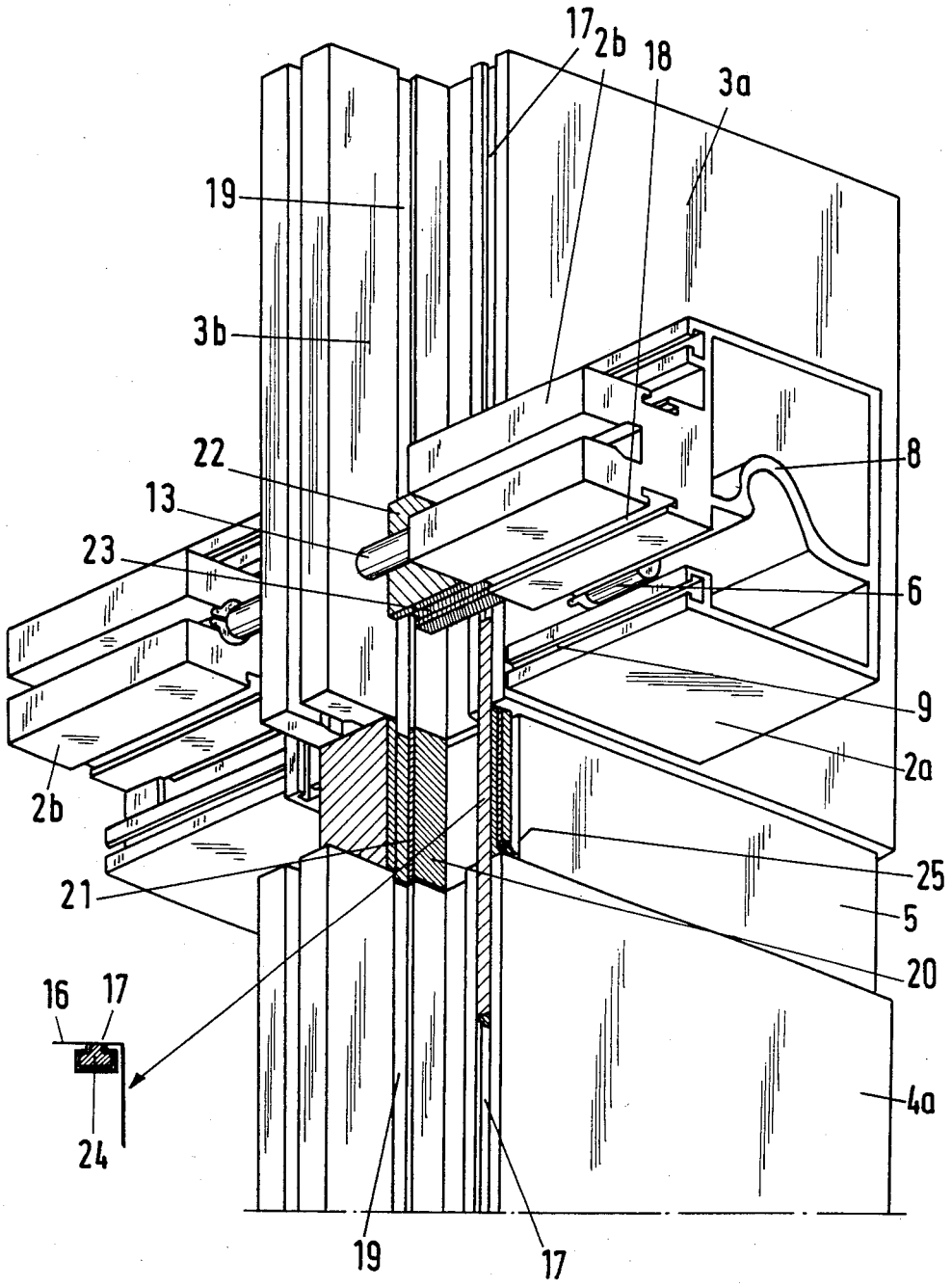
FIG. 3 shows the device of FIG. 2 with inserted filling pieces.

Inserted between the head profile portions 3*b*, 4*b* of the two post profiles 3 and 4 is a flexible insert 20 with a seal retaining groove 21, which is aligned with the seal retaining grooves 19 in the side surfaces of the head profile portion 3*b* of the post 1. Inserted between the head profiles 2*b*, 3*b* of the cross member 2 and of the upper post profile 3 is a flexible insert 22, which has on its lower side and on its upper side a seal retaining groove 23, which is aligned with the corresponding seal retaining groove 18 in the head profile 2*b* of the cross member 2. Furthermore, a filling insert profile 24, extending across the connecting piece 5 between the two vertically adjacent post profiles 3 and 4, is pushed into each of the seal retaining grooves 17 provided in the weather-side box profile surfaces 16 of the two post profiles 3 and 4 (see extracted detail in FIG. 3). This insert profile 24 is positioned by means of a notch 25 in the lower post profile 4. The insert profile 24 could also be replaced by a flat profile laid in place from the outside. The notch 25 could then be omitted if the retaining foot 28 described below is first engaged in the associated seal retaining groove.

Figure 4:
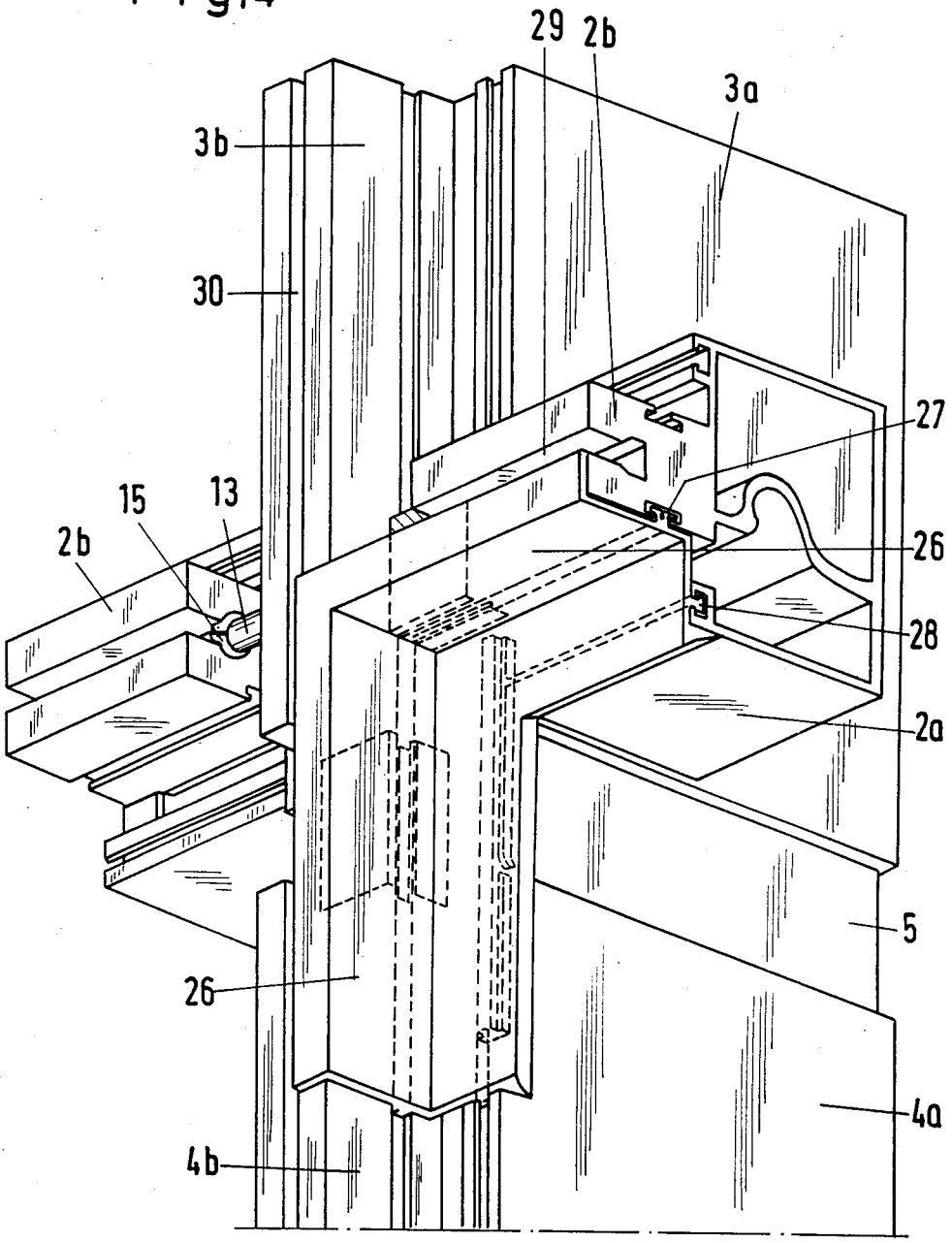
FIG. 4 shows the device of FIG. 3 with a sealing profile attached.

FIG. 4 shows a section of a sealing profile 26 extending around a skeleton panel. A retaining foot 27 on sealing profile 26 is engaged in the lower or upper seal retaining groove 18 in the head profile portion 2*b* of the cross member 2, in the vertical seal retaining grooves 19 in the side surfaces of the head profile portions 3*b* and 4*b* of the two post profiles 3 and 4 and in the corresponding seal retaining groove 21 in the insert 20 arranged therebetween. Furthermore, a second retaining foot 28 on sealing profile 26 is engaged in the lower or upper seal retaining grooves 9 and 10 in the box profile portion 2*a* of the cross member 2 and in the vertical seal retaining grooves 17 in the weather-side box profile surface 16 of the two post profiles 3 and 4. In this arrangement, second retaining foot 28 of the sealing profile 26 is recessed in the region of the filling insert profiles 24.

An assembly slot 29, 30 is provided centrally in the weather-side surface of each head profile portion 3*b*, 4*b* of the post profiles 3 and 4 and of the cross members 2. Sealing profile 26 covers the head profile portions 2*b*, 3*b*, and 4*b* in each case up to the assembly slot 29 and 30.

Cross members 2 may also be provided outside a joint between two post profiles 3, 4.

FIG. 4 shows that the sealing surface lies completely on the weather side, so that no sealing is necessary on the room side between post and cross member.

The foregoing description has been set forth merely to illustrate the invention and is not intended to be limiting. Since modifications of the described embodiments incorporating the spirit and substance of the invention may occur to persons skilled in the art, the scope of the invention should be limited solely with respect to the appended claims and equivalents.

What is claimed is:

1. A facade wall with a loadbearing skeleton of vertical posts and cross members inserted between said posts and connected at right angles thereto, said posts and cross members together forming skeleton panels, provided with a seal, for receiving one plate element each, said posts having a profile comprising in cross-section a room-side box profile portion and a weather-side head profile portion of smaller width and having a vertically extending seal retaining groove in a weather-side box profile surface on either side of the head profile portion, while in the cross member there are provided on the weather side a lower horizontal seal retaining groove and an upper horizontal seal retaining groove, wherein, (a) the cross member profile comprises a box profile portion and a head profile portion, said head profile portion being arranged between said horizontal seal retaining grooves and having in its upper side and in its lower side a horizontal seal retaining groove aligned with a vertical seal retaining groove in an associated side surface of a head profile portion of the post profile; and (b) extending around a skeleton panel is a sealing profile, having a first retaining foot engaged in the lower or upper seal retaining groove in the head profile portion of the cross member and in the vertical seal retaining grooves in the side surfaces of the head profile portions of the two post profiles, said sealing profile further having a second retaining foot engaged in the lower or upper seal retaining groove in the box profile portion of the cross member and in the vertical seal retaining grooves of the weather-side box profile surfaces of the two post profiles.

2. A facade wall according to claim 1, wherein a flexible insert piece with a seal retaining groove is inserted between head profile portions of two vertically adjacent post profiles, and wherein said insert piece seal retaining groove is aligned with seal retaining grooves in side surfaces of said head profile portions of said vertically adjacent post profiles.

3. A facade wall according to claim 1, wherein a flexible insert piece is inserted between the head profile portion of the cross member and the head profile portion of an upper post profile, and wherein said insert piece has seal retaining grooves on its lower side and on its upper side which are aligned with corresponding seal retaining grooves in upper and lower sides of the head profile portion of the cross member.

4. A facade wall according to claim 1, wherein a filling profile extending across a connecting piece which joins two vertically adjacent post profiles, is pushed into each of said vertically extending seal retaining grooves provided in the weather-side box profile surfaces of said two vertically adjacent post profiles.

5. A facade wall according to claim 4, wherein said filling profile is positioned by means of a notch in the lower of said two vertically adjacent post profiles.

6. A facade wall according to claim 4, wherein said second retaining foot of the sealing profile is recessed in the region of said filling profiles.

7. A facade wall according to claim 1, wherein an assembly slot is provided centrally in the weather-side of each cross member head profile portion and each post profile head profile portion, and wherein the sealing profile covers each of the head profile portions up to said assembly slot.

8. The facade wall according to claim 1, wherein at each post/cross member intersection:

(a) two vertically aligned post profiles are connected to each other with a clear variable distance between them by means of a connecting piece inserted in their box profile portions;

(b) a horizontal support bolt is inserted through the box portion of the upper of said two aligned post profiles and simultaneously through an upper section of the said connecting piece and is secured against longitudinal displacement; said support bolt having two ends which protrude out of the box profile and each form a support for a cross member;

(c) the cross member profile has an entry slot for pushing the cross member onto one end of said support bolt and a horizontal support web having a downwardly open, approximately semicircular cross-section, by which the cross member is suspended in its assembled position on said one end of said support bolt; and (d) a horizontal locking bolt is inserted through the head profile portion of said upper post profile, said locking bolt having two ends each of which is received in a corresponding recess in one of two laterally adjacent cross members.

9. A facade wall according to claim 8, wherein said support bolt is secured on either side of the box profile by a Seeger ring, and wherein the length of the cross member is shorter by at least twice the thickness of said Seeger ring than the clear distance between two laterally adjacent posts.

10. A facade wall according to claim 8, wherein said locking bolt is secured in an intermediate space between the head profile portions of two laterally adjacent cross members and the head profile portion of the post profile by a Seeger ring.

11. A facade wall according to claim 8, wherein the cross-section of said support web extends on the weather side by somewhat more than 180° of circumference and forms and undercut for securing the cross member against lifting up.

12. A facade wall according to claim 8, wherein each said recess in which an end of said locking bolt is received is arranged in the head profile portion of the cross member in which it is located.

* * * * *